US007430466B2

(12) United States Patent
Kaneko et al.

(10) Patent No.: US 7,430,466 B2
(45) **Date of Patent: *Sep. 30, 2008**

(54) STEERING FORCE DETECTION DEVICE FOR STEERING HANDLE OF VEHICLE

(75) Inventors: Yoshiyuki Kaneko, Shizuoka-ken (JP); Tomoyoshi Koyanagi, Shizuoka-ken (JP); Yoshinori Harada, Shizuoka-ken (JP); Yutaka Mizuno, Shizuoka-ken (JP)

(73) Assignees: Yamaha Marine Kabushiki Kaisha (JP); Yamaha Motor Co., Ltd. (JP)

( * ) Notice: Subject to any disclaimer, the term of this patent is extended or adjusted under 35 U.S.C. 154(b) by 283 days.

This patent is subject to a terminal disclaimer.

(21) Appl. No.: 11/146,728

(22) Filed: Jun. 7, 2005

(65) Prior Publication Data

US 2006/0004502 A1 Jan. 5, 2006

(30) Foreign Application Priority Data

Jun. 7, 2004 (JP) ..... 2004-169257
Jun. 28, 2004 (JP) ..... 2004-189350

(51) Int. Cl.
*B63H 5/125* (2006.01)

(52) U.S. Cl. ..... 701/41; 701/21; 114/55.5

(58) Field of Classification Search ..... None
See application file for complete search history.

(56) References Cited

U.S. PATENT DOCUMENTS 3,183,879 A 5/1965 Heidner
4,423,630 A 1/1984 Morrison
4,445,473 A 5/1984 Matsumoto
4,492,195 A 1/1985 Takahashi et al.
4,556,005 A 12/1985 Jackson (Continued)

FOREIGN PATENT DOCUMENTS

CA 2271332 2/2000

(Continued)

OTHER PUBLICATIONS

Co-Pending U.S. Appl. No. 11/146,980 filed Jun. 7, 2005. Title: Steering-Force Detection Device for Steering Handle of Vehicle. Inventors: Yoshiyuki Kaneko et al.

(Continued)

*Primary Examiner*—Michael J. Zanelli
(74) *Attorney, Agent, or Firm*—Knobbe, Martens, Olson & Bear, LLP

(57) ABSTRACT

A watercraft has steering force detection sections. Each steering force detection section includes a pressure receiving section. The pressure receiving sections are spaced from each other and are in the vicinity of a steering shaft. A pressing member is coupled to the steering shaft. The pressing member can press on at least one of the pressure receiving sections when the steering handlebars are rotated to a maximum steering angle. A received pressure detection section detects the pressure applied to the pressure receiving section. The pressure receiving section and the received pressure detection section are coaxially mounted in a pressure receiving section casing and a detection section casing. A guide tube can engage the pressure receiving section and the received pressure detection section. The guide tube is formed with ribs and grooves. The pressure receiving section has a pressure receiving member, a bolt, a plain washer, and a spring member.

20 Claims, 9 Drawing Sheets

U.S. PATENT DOCUMENTS

| | | | |
|---|---|---|---|
| 4,767,363 | A | 8/1988 | Uchida et al. |
| 4,949,662 | A | 8/1990 | Kobayashi |
| 4,961,396 | A | 10/1990 | Sasagawa |
| 4,971,584 | A | 11/1990 | Inoue et al. |
| 4,972,792 | A | 11/1990 | Yokoyama et al. |
| 4,989,533 | A | 2/1991 | Horuichi |
| 5,094,182 | A | 3/1992 | Simner |
| 5,113,777 | A | 5/1992 | Kobayashi |
| 5,118,315 | A | 6/1992 | Funami et al. |
| 5,144,300 | A | 9/1992 | Kanno |
| 5,167,546 | A | 12/1992 | Whipple |
| 5,167,547 | A | 12/1992 | Kobayashi et al. |
| 5,169,348 | A | 12/1992 | Ogiwara et al. |
| 5,184,589 | A | 2/1993 | Nonaka |
| 5,199,261 | A | 4/1993 | Baker |
| 5,203,727 | A | 4/1993 | Fukui |
| 5,244,425 | A | 9/1993 | Tasaki et al. |
| 5,350,325 | A | 9/1994 | Nanami |
| 5,352,138 | A | 10/1994 | Kanno |
| 5,366,394 | A | 11/1994 | Kanno |
| 5,367,970 | A | 11/1994 | Beauchamp et al. |
| 5,408,948 | A | 4/1995 | Arii et al. |
| 5,429,533 | A | 7/1995 | Kobayashi et al. |
| 5,474,007 | A | 12/1995 | Kobayashi |
| 5,520,133 | A | 5/1996 | Wiegert |
| 5,538,449 | A | 7/1996 | Richard |
| 5,591,057 | A | 1/1997 | Dai et al. |
| 5,603,644 | A | 2/1997 | Kobayashi et al. |
| 5,665,025 | A | 9/1997 | Katoh |
| 5,687,694 | A | 11/1997 | Kanno |
| 5,697,317 | A | 12/1997 | Pereira |
| 5,707,264 | A | 1/1998 | Kobayashi et al. |
| 5,713,297 | A | 2/1998 | Tani et al. |
| 5,805,054 | A | 9/1998 | Baxter |
| 5,826,557 | A | 10/1998 | Motoyama et al. |
| 5,839,700 | A | 11/1998 | Nedderman, Jr. |
| 5,904,604 | A | 5/1999 | Suzuki et al. |
| 5,908,006 | A | 6/1999 | Ibata |
| 5,941,188 | A | 8/1999 | Takashima |
| 5,988,091 | A | 11/1999 | Willis |
| 6,032,605 | A | 3/2000 | Takashima |
| 6,032,653 | A | 3/2000 | Anamoto |
| 6,038,995 | A | 3/2000 | Karafiath et al. |
| 6,062,154 | A | 5/2000 | Ito |
| 6,086,437 | A | 7/2000 | Murray |
| 6,102,755 | A | 8/2000 | Hoshiba |
| 6,116,971 | A | 9/2000 | Morikami |
| 6,135,095 | A | 10/2000 | Motose et al. |
| 6,138,601 | A | 10/2000 | Anderson et al. |
| 6,148,777 | A | 11/2000 | Motose et al. |
| 6,159,059 | A | 12/2000 | Bernier et al. |
| 6,168,485 | B1 | 1/2001 | Hall et al. |
| 6,171,159 | B1 | 1/2001 | Shen et al. |
| 6,174,210 | B1 | 1/2001 | Spade et al. |
| 6,178,907 | B1 | 1/2001 | Shirah et al. |
| 6,202,584 | B1 | 3/2001 | Madachi et al. |
| 6,213,044 | B1 | 4/2001 | Rodgers et al. |
| 6,216,624 | B1 | 4/2001 | Page |
| 6,227,919 | B1 | 5/2001 | Blanchard |
| 6,244,914 | B1 | 6/2001 | Freitag et al. |
| 6,273,771 | B1 | 8/2001 | Buckley et al. |
| 6,305,307 | B1 | 10/2001 | Yokoya |
| 6,314,900 | B1 | 11/2001 | Samuelsen |
| 6,332,816 | B1 | 12/2001 | Tsuchiya et al. |
| 6,336,833 | B1 | 1/2002 | Rheault et al. |
| 6,336,834 | B1 | 1/2002 | Nedderman, Jr. et al. |
| 6,386,930 | B2 | 5/2002 | Moffet |
| 6,390,862 | B1 | 5/2002 | Eichinger |
| 6,405,669 | B2 | 6/2002 | Rheault et al. |
| 6,415,729 | B1 | 7/2002 | Nedderman, Jr. et al. |
| 6,428,371 | B1 | 8/2002 | Michel et al. |
| 6,428,372 | B1 | 8/2002 | Belt |
| 6,443,785 | B1 | 9/2002 | Swartz et al. |
| 6,478,638 | B2 | 11/2002 | Matsuda et al. |
| 6,508,680 | B2 | 1/2003 | Kanno |
| 6,511,354 | B1 | 1/2003 | Gonring et al. |
| 6,523,489 | B2 | 2/2003 | Simzrd et al. |
| 6,530,812 | B2 | 3/2003 | Koyano et al. |
| 6,551,152 | B2 | 4/2003 | Matsuda et al. |
| 6,565,397 | B2 | 5/2003 | Nagafusa |
| 6,568,968 | B2 | 5/2003 | Matsuda et al. |
| 6,668,796 | B2 | 12/2003 | Umemoto et al. |
| 6,695,657 | B2 | 2/2004 | Hattori |
| 6,709,302 | B2 | 3/2004 | Yanagihara |
| 6,709,303 | B2 | 3/2004 | Umemoto et al. |
| 6,722,302 | B2 | 4/2004 | Matsuda et al. |
| 6,722,932 | B2 | 4/2004 | Yanagihara |
| 6,732,707 | B2 | 5/2004 | Kidokoro et al. |
| 6,733,350 | B2 | 5/2004 | Iida et al. |
| 6,776,676 | B2 | 8/2004 | Tanaka et al. |
| 6,783,408 | B2 | 8/2004 | Uraki et al. |
| 6,805,094 | B2 | 10/2004 | Hashimoto et al. |
| 6,827,031 | B2 | 12/2004 | Aoyama |
| 6,855,014 | B2 | 2/2005 | Kinoshita et al. |
| 6,863,580 | B2 | 3/2005 | Okuyama |
| 6,884,128 | B2 | 4/2005 | Okuyama et al. |
| 6,886,529 | B2 | 5/2005 | Suzuki et al. |
| 6,990,953 | B2 | 1/2006 | Nakahara et al. |
| 6,997,763 | B2 | 2/2006 | Kaji |
| 7,037,147 | B2 | 5/2006 | Ito et al. |
| 7,077,713 | B2 | 7/2006 | Watabe et al. |
| 7,168,995 | B2 | 1/2007 | Masui et al. |
| 7,175,490 | B2 | 2/2007 | Kanno et al. |
| 7,207,856 | B2 | 4/2007 | Ishida et al. |
| 2003/0000500 | A1 | 1/2003 | Chatfield |
| 2003/0089166 | A1* | 5/2003 | Mizuno et al. ..... 73/118.1 |
| 2004/0069271 | A1 | 4/2004 | Kanno et al. |
| 2004/0147179 | A1 | 7/2004 | Mizuno et al. |
| 2005/0009419 | A1 | 1/2005 | Kinoshita |
| 2005/0085141 | A1 | 4/2005 | Mototse |
| 2005/0263132 | A1 | 12/2005 | Yanagihara |
| 2005/0273224 | A1 | 12/2005 | Ito et al. |
| 2005/0287886 | A1 | 12/2005 | Ito et al. |
| 2007/0021015 | A1 | 1/2007 | Kinoshita et al. |

FOREIGN PATENT DOCUMENTS

| | | |
|---|---|---|
| JP | 06-137248 | 5/1994 |
| JP | 7-40476 | 9/1995 |
| JP | 2001-152895 | 6/2001 |
| JP | 2001-329881 | 11/2001 |
| JP | 2004-092640 | 3/2004 |
| JP | 2004-137920 | 5/2004 |
| WO | WO 00/40462 | 7/2000 |

OTHER PUBLICATIONS

Co-pending U.S. Appl. No. 11/083,290, filed Mar. 17, 2005. Title: Engine Control Device. Inventor: Ishida et al.
Co-pending U.S. Appl. No. 11/335,996, filed Jan. 20, 2006. Title: Operation Control System for Small Boat. Inventor: Kinoshita et al.
Co-pending U.S. Appl. No. 11/336,711, filed Jan. 20, 2006. Title: Operation Control System for Planing Boat. Inventor: Kinoshita et al.
Advertisement for trim adjuster for Sea-Doo watercraft—Personal Watercraft Illustrated, Aug. 1998.
Advertisement for trim adjuster—Jet Sports, Aug. 1997.
Advertisement for Fit and Trim and Fit and Trim II—Jet Sports. Aug. 1996.

* cited by examiner

STEERING FORCE DETECTION DEVICE FOR STEERING HANDLE OF VEHICLE

PRIORITY INFORMATION

The present application is based on and claims priority under 35 U.S.C. § 119(a-d) to Japanese Patent Application No. 2004-169257, filed on Jun. 7, 2004, and Japanese Patent Application No. 2004-189350, filed on Jun. 28, 2004, the entire contents of which are expressly incorporated by reference herein.

BACKGROUND OF THE INVENTIONS

1. Field of the Inventions

The present inventions relate to a steering force detection device of a vehicle and, more particularly, to a steering force detection device that detects a steering force when a steering handle is rotated to a predetermined steering angle.

2. Description of the Related Art

Vehicles typically have a steering device for controlling the direction that the vehicle travels. Personal watercraft or small planing boats often have a steering handle for controlling the direction the vehicle travels. These vehicles typically have a throttle lever disposed in the vicinity of a grip of the steering handle. The throttle lever is operated to control the output of the engine. When the vehicles are maneuvered at low speeds, the engine output may be very low thereby reducing the steerability of the vehicle. Japanese Patent Publication No. JP-A-2001-329881 discloses operating a steering handle to increase the engine output for improving the steerability of the small planing boat when running at a low speed for docking.

Such watercraft often include a throttle opening detector for measuring the opening of a throttle valve controlled by the throttle lever. The steering angle of the steering handle can be measured by a steering angle detector. The speed of watercraft can be measured by a vehicle speed detector. The watercraft can have an engine output control for controlling the engine output. The engine output control increases the engine output when (1) the throttle opening detected by the throttle opening detector is equal to or less than a predetermined opening, (2) the steering angle detector measures a steering angle equal to or greater than a than a predetermined steering angle, and (3) the speed of the watercraft measured by the vehicle speed detector is equal to or greater than a predetermined value.

In the device of the JP-A-2001-329881 publication, the increase in engine output due to operation of the steering handle cannot be adjusted because of the engine output being increased automatically when the steering angle of the steering handle reaches the predetermined steering angle. On the other hand, the watercraft may be provided with a steering force detection device for controlling the engine output based on the steering force of the steering handle. However, the steering force detection device can be inaccurate, especially when the casing of the steering force detection device is not machined accurately.

SUMMARY OF THE INVENTIONS

An aspect of at least one of the embodiments disclosed herein includes the realization that some the manufacturing and assembly processes can be simplified and/or improved by arranging the steering force sensor assembly such that the sensors and/or pressure receiving sections are arranged generally parallel to each other and extend in a direction that is generally perpendicular to the direction along which they are spaced.

Thus in accordance with an embodiment, a steering force detection device for a steering handle of a vehicle is provided. The device can comprise a pair of steering force detection sections spaced from each other and near a steering shaft connected to a steering handle of a vehicle. Each steering force detection section can include a pressure receiving section. A pressing member can be connected to the steering handle or the steering shaft, the pressing member comprising a pair of pressing sections. The pressing member can be configured such that one of the pressing sections presses against one of the pressure receiving sections when the steering handle is rotated to a first position, the other pressing section presses against the other pressure receiving section when the steering handle is rotated to a second position. The steering force detection device can be configured to detect a steering force of the steering handle based on a pressure applied by one of the pressing sections to one of the pressure receiving sections. The pair of steering force detection sections can be positioned such that the pressure receiving sections are spaced apart by a distance, wherein the pressure receiving sections are actuatable along lines of action that are generally parallel to each other and generally perpendicular to the distance.

In accordance with another embodiment, a steering force detection device for a steering handle of a vehicle is provided. A first force sensor and a second force sensor can be spaced from each other and near a steering shaft connected to a steering handle of a vehicle, the first force sensor and the second for sensor being configured to measure a steering force. A pressing member can be connected to the steering handle or the steering shaft. The pressing member can comprise a first pressing section and a second pressing section, the pressing member being configured such that the first pressing section presses against the first force sensor when the steering handle is rotated to a first position, the second pressing section presses against the second force sensor when the steering handle is rotated to a second position. The first force sensor and the second force sensor can be positioned to measure a first force and a second force, respectively, that are generally parallel to each other, and the first force and the second force are offset from each other.

In some embodiments, the two received pressure detection sections and the electric circuit board are connected and integrated to each other. They can be housed in the detection section casing as a one-piece body. The detection section casing can have two received pressure detection section mounting cavities and a circuit board housing recess that facilitate the assembly and mountability of the two received pressure detection sections and the electric circuit board to the detection section casing. Since the mounting openings of the detection section casing for the received pressure detection sections and the electric circuit board are formed in the same direction as each other, the two received pressure detection sections and the electric circuit board can be inserted into the detection section casing from the same direction. This further facilitates the assembly of the two received pressure detection sections and the electric circuit board to the detection section casing. Also, since the mounting openings of the detection section casing for the received pressure detection sections and the electric circuit board can be generally perpendicular to the pressure receiving direction (e.g., a line of action) of the pressure receiving sections, the two received pressure detection sections and the electric circuit board can be assembled to the detection section casing so as not to move (e.g., rattle) with respect to the pressure receiving direction.

In some embodiments, a guide tube is mounted across a received pressure detection section mounting cavity of a detection section casing and a pressure receiving section mounting cavity of a pressure receiving section casing. The received pressure detection section is mounted in the guide tube on the detection section casing side while the pressure receiving section is mounted in the guide tube on the pressure receiving section casing side.

As such, the received pressure detection section and the pressure receiving section can be easily aligned, preferably aligned coaxially. Alignment of the received pressure detection section and the pressure receiving section may be difficult when the detection section casing and the pressure receiving section casing (as separate members) are assembled to each other. Alignment of the received pressure detection section and the pressure receiving section may also be difficult when the detection section casing houses the received pressure detection section in its received pressure detection section mounting cavity. Alignment of the received pressure detection section and the pressure receiving section may also be difficult when the pressure receiving section casing houses the pressure receiving section in its pressure receiving section mounting cavity. However, the guide tube can be used to coaxially position the received pressure detection section and the pressure receiving section. This also improves the assembly accuracy of the detection section casing and the pressure receiving section casing. As a result, the steering force of the steering handle is transmitted directly from the pressure receiving section to the received pressure detection section, thus improving the detection accuracy of the steering force.

In some embodiments, the guide tube is configured to reduce or prevent movement of the received pressure detection section and/or the pressure receiving section disposed therein. The guide tube can have any number of ribs configured to engage the received pressure detection section or the pressure receiving section. The ribs can engage the received pressure detection section or the pressure receiving section mounted in the guide tube limit or prevent misalignment (e.g., leaning) of the received pressure detection section or the pressure receiving section. The ribs can therefore maintain the central position of the received pressure detection section or the pressure receiving section with respect to the guide tube.

In some embodiments, a sealing member is configured to form a seal between a fitting portion of the detection section casing and the pressure receiving section casing and a portion of an outside wall surface of the guide tube corresponding to the fitting portion. The fitting portion of the detection section casing and the pressure receiving section casing can be sealed. If the vehicle is a watercraft vehicle (e.g., a planing boat), water can be prevented from entering the guide tube. In some embodiments, the vehicle is a land vehicle (e.g., motorcycle) and containments (e.g., dust, rainwater, etc.) can be prevented from entering the guide tube.

In some embodiments, the fitting surfaces of the detection section casing and the pressure receiving section casing are somewhat flat and perpendicular to the pressure receiving direction of the pressure receiving section. This can improve the positional accuracy between the received pressure detection section and the pressure receiving section.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
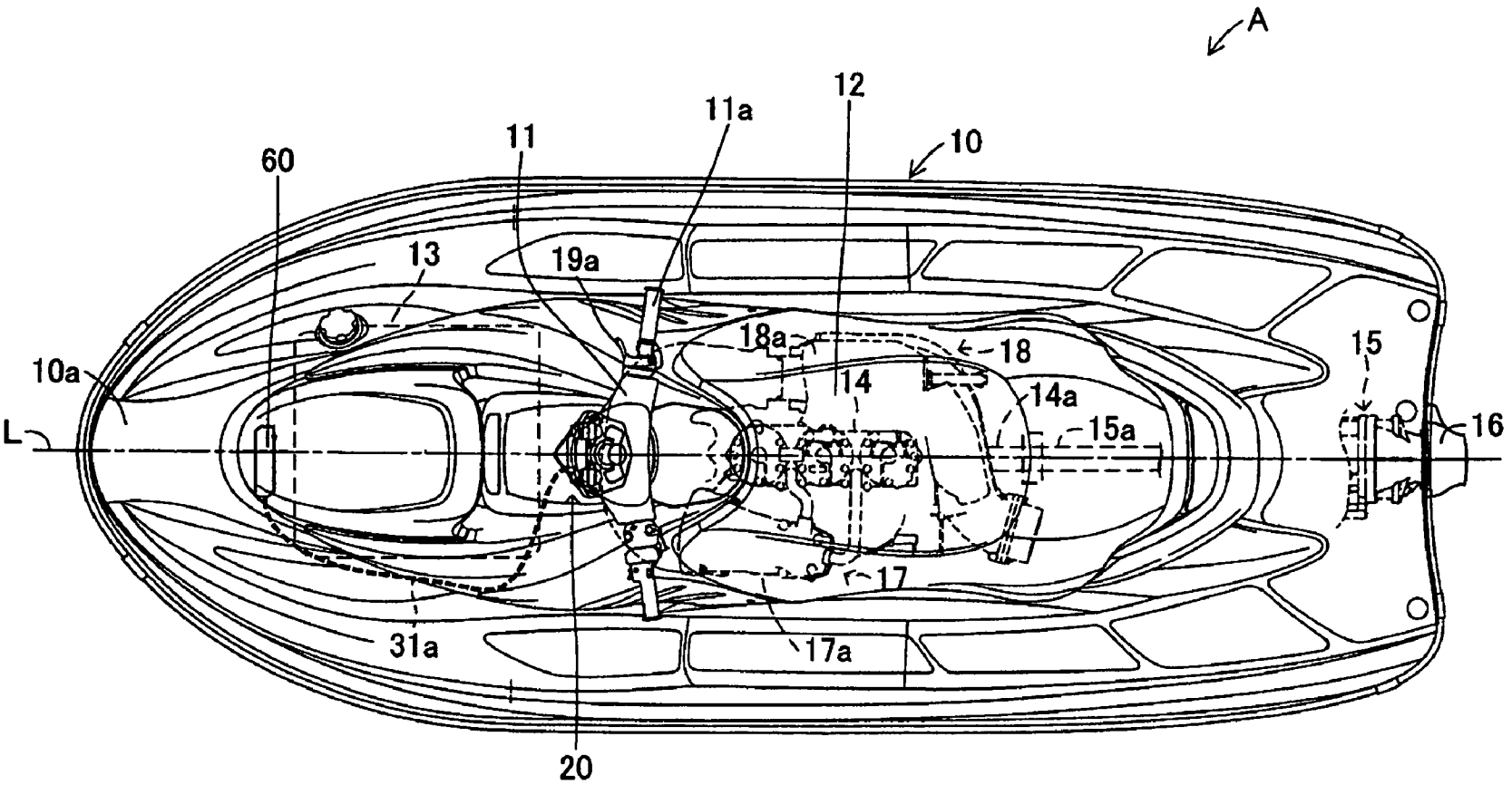
FIG. 1 is a top plan view of a personal watercraft having a steering force detection device.
Figure 2:
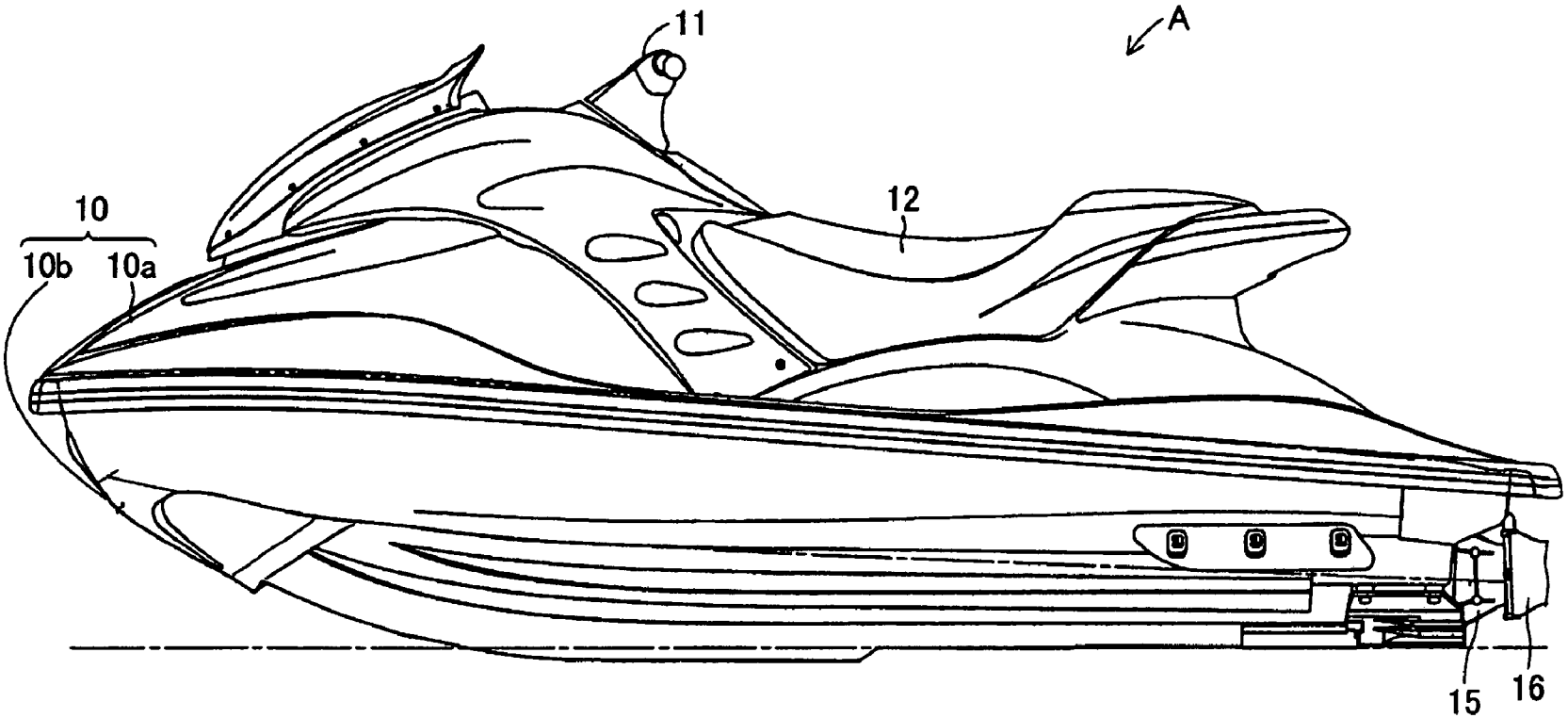
FIG. 2 is a side view of the personal watercraft of FIG. 1.

FIGS. 1 and 2 illustrate a small planing boat A (also commonly referred to as a "Personal watercraft") including a preferred embodiment of the present steering-force detection device for a steering handle of a vehicle. The steering-force detection device is illustrated in the context of a personal watercraft because it has particular utility in this context. However, the steering-force detection device can also be used in other vehicles, including small jet boats, as well as other watercraft and land vehicles, including, but without limitation motorcycles.

With reference to FIG. 2, the small planing boat A has a boat body 10, including a deck 10*a* and a lower hull 10*b*. The boat body 10 can have steering handlebars 11 located slightly in front of its center on its upper part, and a seat 12 located centrally of the upper part. With reference to FIG. 1, a fuel tank 13 for storing fuel is disposed at the front bottom inside the boat body 10, and an engine 14 is disposed at the center bottom inside the boat body 10.

With continued reference to FIGS. 1 and 2, a propulsion unit 15 is disposed generally centrally in the width direction of the boat body 10 (the portion indicated by a center line L) at the rear end of the boat body 10. The propulsion unit 15 is coupled to the engine 14 via an impeller shaft 15*a*.

A steering nozzle 16 is mounted to the rear end of the propulsion unit 15. The steering nozzle 16 is coupled to the steering handlebars 11 via a push-pull wire 16*a* and a steering arm 16*b*, etc. (see FIG. 4). The rear part of the steering nozzle 16 is pivotable laterally in response to operation of the steering handlebars 11. Pivoting of the steering nozzle 16 changes the direction of travel for the small planing boat A.

The engine 14 is connected to an intake system 17 for guiding a mixture of fuel fed from the fuel tank 13 and air to the engine 14. The engine 14 is also connected to an exhaust system 18 for emitting an exhaust gas from the engine 14 to the outside from the rear end of the boat body 10.

The engine 14 can comprise, for example but without limitation, a two-cycle, three-cylinder engine. However, ht is merely one type of engine that can be used. The engine 14 can optionally have other numbers of cylinders, operate on other combustion principles (e.g., diesel, rotary, four stroke, etc), and have other cylinder configurations (e.g., V-type, W-type, horizontally opposed, etc.).

During operation, the engine 14 takes in an air-fuel mixture at its intake ports, and discharges an exhaust gas through its exhaust ports. The mixture fed into the engine 14 explodes when ignited by an ignition system provided in the engine 14, and the explosion causes pistons provided in the engine 14 to reciprocate up and down. The reciprocating motion of the pistons drives a crankshaft 14*a* to rotate. The crankshaft 14*a* is coupled to the impeller shaft 15*a*, to transmit its rotational force to the impeller shaft 15*a* and drive the impeller shaft 15*a* to rotate.

The impeller shaft can be formed from a single shaft, or a plurality of shafts connected together. The rear end of the impeller shaft 15*a* is coupled to an impeller (not shown) disposed in the propulsion unit 15. When the impeller rotates, thrust is generated and the small planing boat A gains speed.

The propulsion unit 15 has a water inlet opening (not shown) at the bottom of the boat body 10 and a water jet nozzle (not shown) opening at the stem. Seawater introduced from the water inlet is ejected from the water jet nozzle by the rotation of the impeller to generate thrust for the small planing boat A.

With reference to FIG. 2, in the illustrated embodiment, the intake system 17 comprises an intake pipe 17*a* connected to the engine 14, a throttle body connected to the upstream end of the intake pipe 17*a*, and may comprise various other components. The intake system 17 takes in outside air and guides it to the engine 14. The air flow rate can be adjusted by opening and closing a throttle valve 19 (FIG. 11) provided in the throttle body. The air fed to the engine 14 is mixed with fuel fed from the fuel tank 13 via a fuel system (not shown).

In the illustrated embodiment, the exhaust system 18 includes an exhaust pipe 18*a* connected to the engine 14, a tank-shaped water lock connected to the rear end of the exhaust pipe 18*a*, an exhaust pipe (not shown) connected to the rear portion of the water lock, and can comprise various other components. The exhaust pipe 18*a* starts at the exhaust port of each cylinder of the engine 14, and merges at a point between the ports and the water lock.

An exhaust pipe extends rearward from the rear portion of the upper surface of the water lock. The exhaust pipe can extend initially upward and then downward and rearward, with its downstream end opening at the lower portion of the rear end of the boat body 10.

Figure 3:
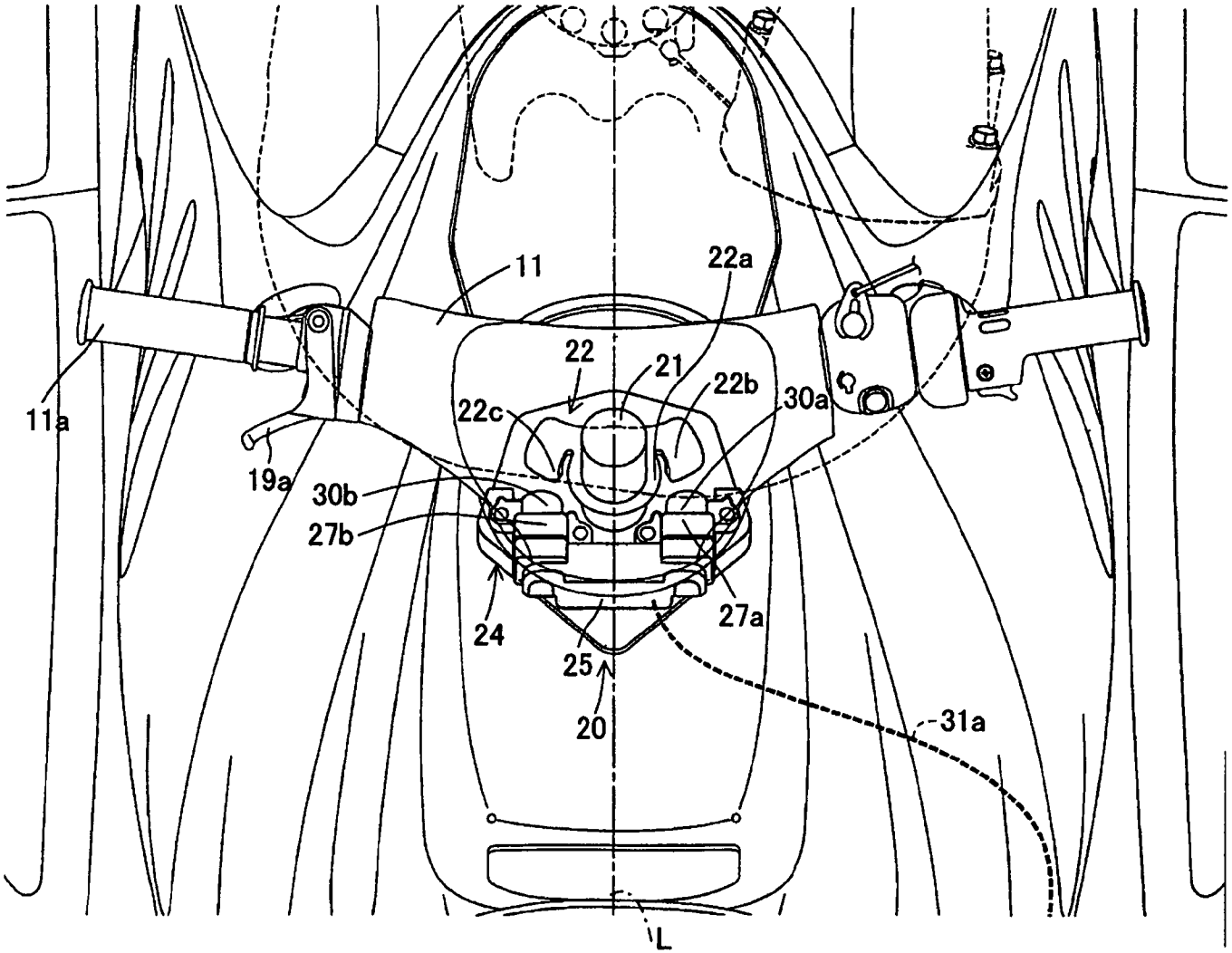
FIG. 3 is an enlarged plan view of a steering assembly and the steering force detection device of FIG. 1.

With reference to FIGS. 2 and 3, the illustrated boat A includes a throttle lever 19*a* in the vicinity of a grip 11*a* of the steering handlebars 11. The throttle lever 19*a* is supported for rotation around an axis and adapted to move toward/away from the peripheral surface of the grip 11*a*.

The throttle valve 19 opens and closes in response to operation of the throttle lever 19*a*. Thus, the throttle lever 19*a* can be considered to be a power output request device. For example, when the lever 19*a* is squeezed by an operator, the power output of the engine rises in accordance with the operator's "request" (the extent to which the operator squeezed the lever 19*a*). The throttle vale 19 can be connected to the throttle lever 19*a* with a direct wire connection, or the throttle valve 19 can be electronically controlled based on detected movements of the throttle lever 19*a*. In other embodiments, the power output of the engine 14 can be controlled in other ways without a throttle valve, e.g., throttle less engines using variable valve timing to control air flow to the engine 14.

A preferred embodiment of the present steering-force detection device 20 is housed beneath the steering handlebars 11 and inside the boat body 10. Those of ordinary skill in the art will appreciate that, even though the steering-force detection device 20 is hidden from view inside the boat body 10, it is nevertheless illustrated with solid lines in FIGS. 1 and 3 for easy understanding.

Figure 4:
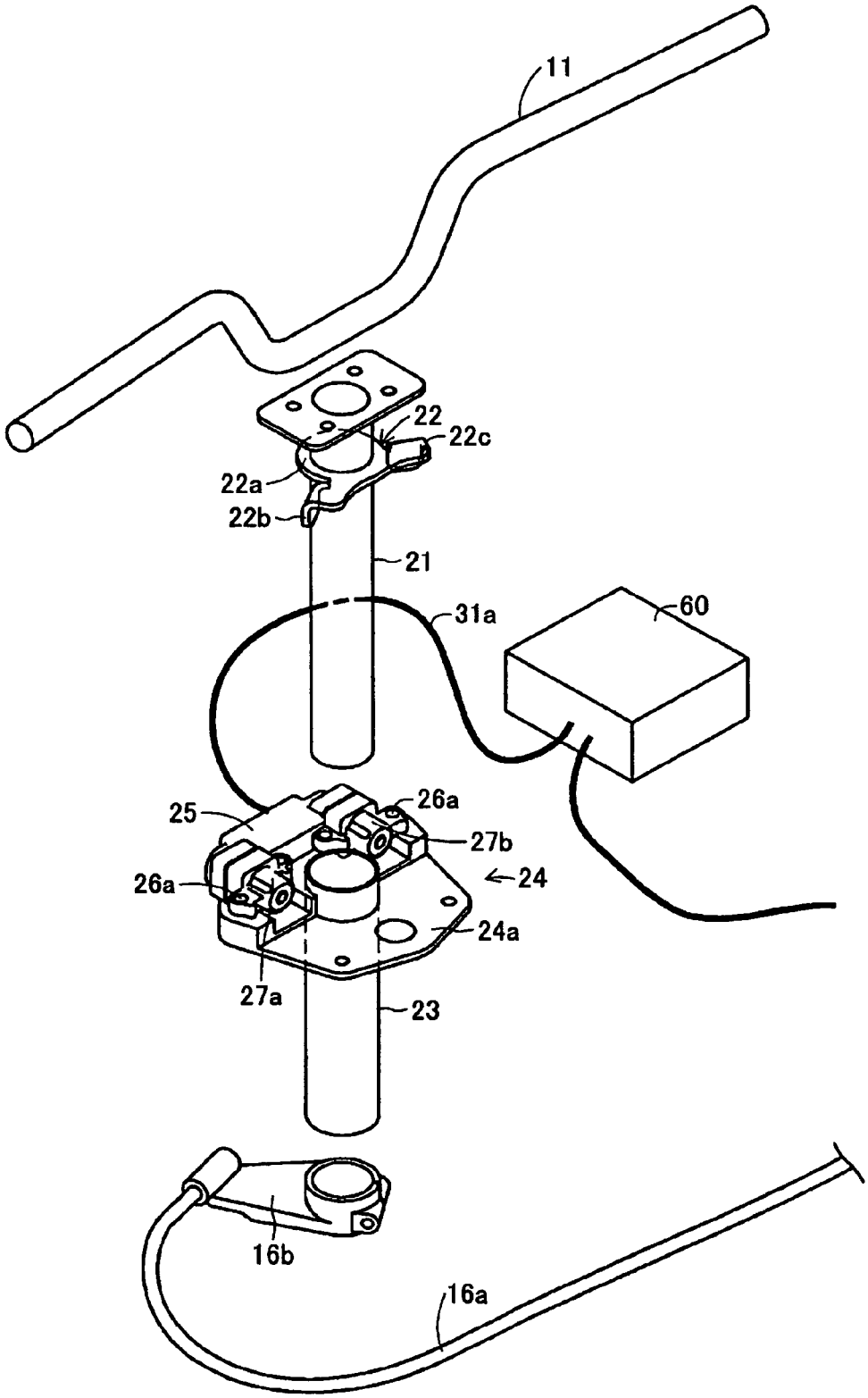
FIG. 4 is an exploded perspective view of a portion of a steering assembly and an associated steering force detection device.

With reference to FIGS. 3 and 4, the steering-force detection device 20 can comprise a pressing member 22 attached to a steering shaft 21, which extends generally vertically and is coupled to the center of the steering handlebars 11 for rotation in response to operation of the steering handlebars 11, and a steering-force detection section unit 24, which is fixed to a cylindrical steering shaft receiving section 23 for supporting the steering shaft 21 for rotation. The steering-force detection section unit 24 can be adapted to detect the steering force received from the pressing member 22 when it comes into contact with the pressing member 22. Such contact occurs when the steering shaft 21 is rotated to a predetermined angle.

With particular reference to FIG. 4, the pressing member 22 can comprise a ring-shaped fixed portion 22*a* that is fixed to the outer peripheral surface of the steering shaft 21. The pressing member 22 can further comprise a pair of L-shaped pressing pieces 22*b*, 22*c*. Each pressing piece 22*b*, 22*c* can include a horizontal portion projecting obliquely rearward from the fixed portion 22*a* and a vertical portion extending downward from the front edge of the horizontal portion.

The pressing member 22 can be mounted symmetrically around the steering shaft 21. The vertical portion of the pressing piece 22*b* can be perpendicular to the center line L when the steering handlebars 11 are rotated clockwise to a maximum steering angle, as viewed from above. Similarly, the vertical portion of the pressing piece 22*c* can be perpendicular to the center line L when the steering handlebars 11 are rotated counterclockwise to a maximum steering angle, as viewed from above.

Figure 5:
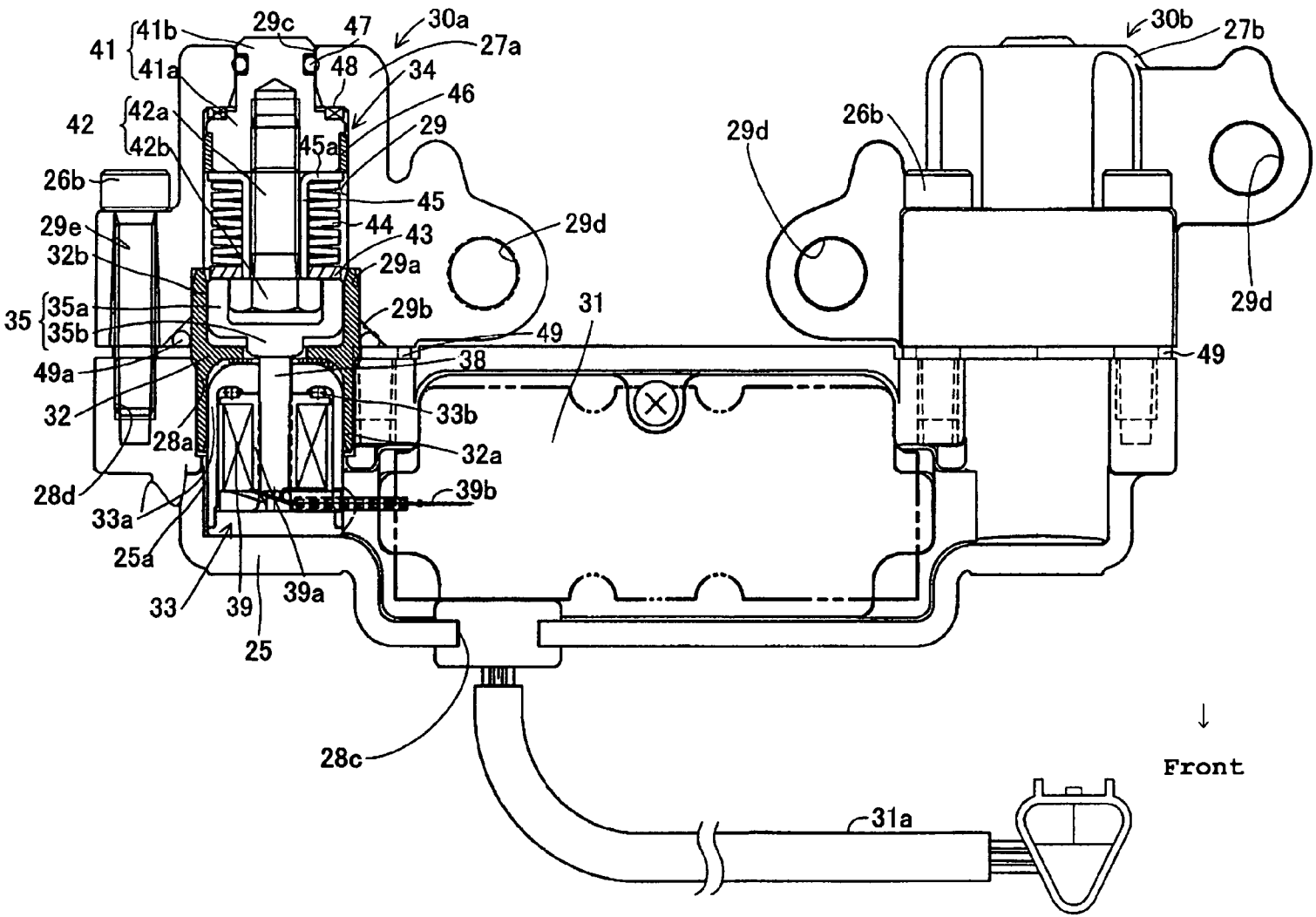
FIG. 5 is a partial sectional view showing the inside of a steering force detection section unit of a steering force detection device, as viewed from its lower side.

With reference to FIGS. 4 and 5, in the illustrated embodiment the steering-force detection section unit 24 includes a mounting plate 24*a*, a detection section casing 25, and a pair of pressure-receiving section casings 27*a*, 27*b*. The mounting plate 24*a* can be fixed to the outer peripheral surface of the steering shaft receiving section 23.

The detection section casing 25 can be fixed to the upper surface of the mounting plate 24*a* by, for example, a bolt (not shown). The pressure-receiving section casings 27*a*, 27*b* can be fixed to the upper surface of the mounting plate 24*a* by, for example, a bolt 26*a*, and respectively fixed to the left and right ends of the rear end of the detection section casing 25 by, for example, a bolt 26*b* (FIG. 5).

With reference to FIG. 5, which is a lower plan view, a pair of steering-force detection sections 30*a*, 30*b* and an electric circuit board 31 are situated in a recess defined by the mounting plate 24*a*, the detection section casing 25 and the pair of pressure-receiving section casings 27*a*, 27*b*.

Figure 6:
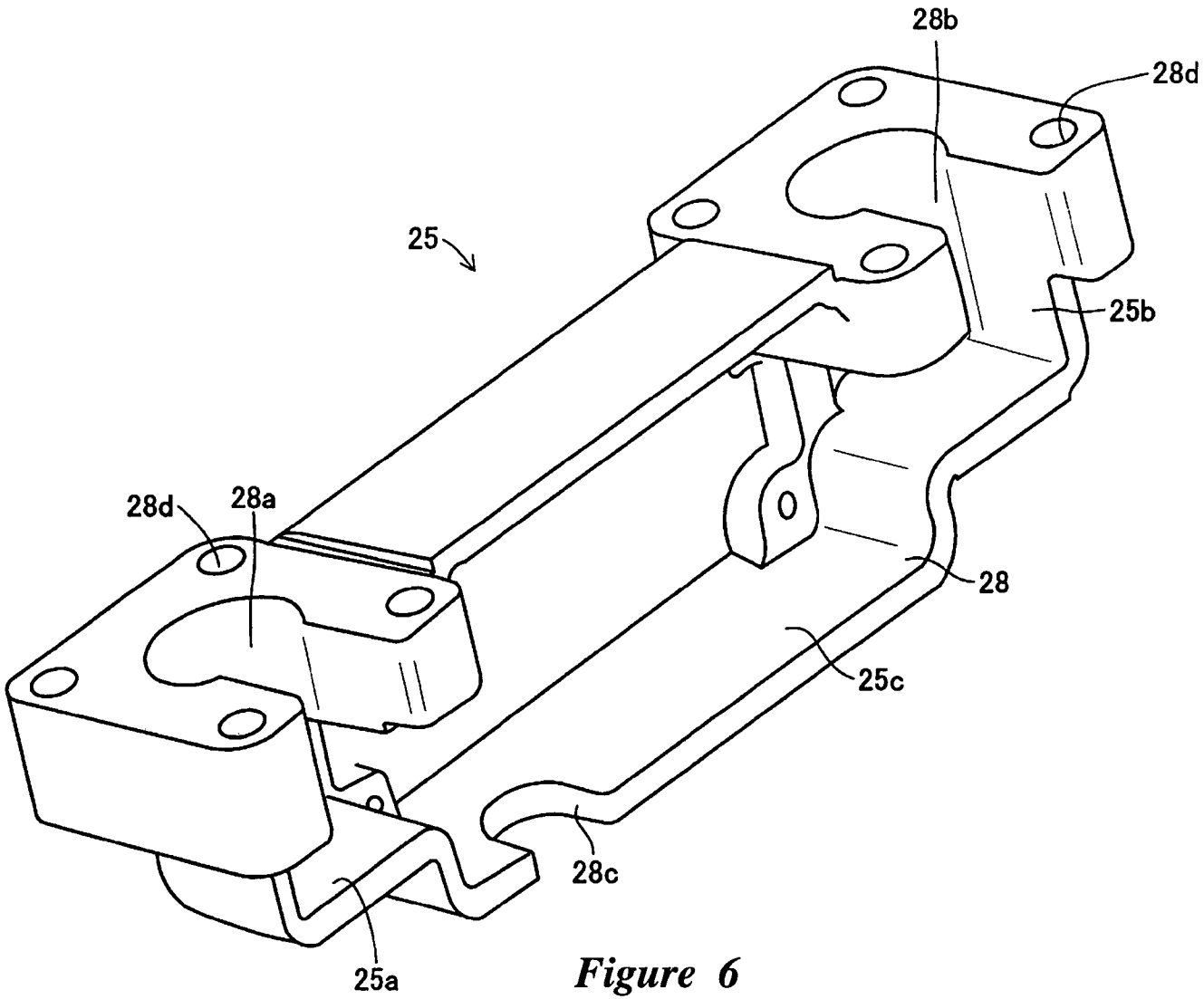
FIG. 6 is a perspective view of a detection section casing of the steering force detection device of FIG. 1.

With reference to FIG. 6, a portion of the detection section casing 25 facing the mounting plate 24*a* (the near side in FIG. 6, or the lower surface of the detection section casing 25) forms a mounting opening 28. The mounting opening 28 receives the front portions of the pair of steering-force detection sections 30*a*, 30*b* and the electric circuit board 31.

Mounting cavities 25*a*, 25*b* can be configured to receive the front portions of the steering-force detection sections 30*a*, 30*b*, are can be respectively formed in both the left and right portions inside the detection section casing 25. A circuit board housing recess 25*c* can be formed in the center portion inside the detection section casing 25.

The mounting cavities 25*a*, 25*b* and the circuit board housing recess 25*c* can be in communication with each other inside the detection section casing 25. Connecting openings 28*a*, 28*b* in the rear (upper side in FIG. 6) of the mounting cavities 25*a*, 25*b* can be configured to allow communication between the mounting cavities 25*a*, 25*b* and the pressure-receiving section casings 27*a*, 27*b*.

The connecting openings 28*a*, 28*b* can be formed so as to extend perpendicularly to the mounting opening 28. A notch 28*c* for passing wiring 31*a* out of the circuit board housing recess 25*c* can be formed on one side of the front wall of the circuit board housing recess 25*c*. A plurality of bolt holes 28*d* for fitting the bolts 26*b* are formed around the connecting openings 28*a*, 28*b* in the rear surface of the detection section casing 25. In the illustrated embodiment, the bolt holes 28*d* are parallel to the mounting cavities 25*a*, 25*b*.

With reference to FIG. 5, in the illustrated embodiment the pressure-receiving section casings 27*a*, 27*b* are formed symmetrically with respect to each other. Each of the casings 27*a*, 27*b* can include a mounting cavity 29 for mounting the rear portion of the steering-force detection section 30*a* or 30*b* (the mounting cavity 29 of the pressure-receiving section casing 27*b* is not shown).

The pressure-receiving section casings 27*a*, 27*b* can be formed symmetrically with respect to each other, and the mounting cavities 25*a*, 25*b*, and the steering-force detection sections 30*a*, 30*b* can also have the same structure as each other. Therefore, a description of the construction of the pressure-receiving section casing 27*a* and steering-force detection section 30*a* is made hereinafter, and that of the pressure-receiving section casing 27*b* and steering-force detection section 30*b* is not made.

As shown in FIG. 5, the front end of the mounting cavity 29, which is formed in the pressure-receiving section casing 27*a*, can include a connecting opening 29*a* having a diameter slightly larger than the connecting opening 28*a* of the detection section casing 25, and in communication with the connecting opening 28*a*. The front end of the connecting opening 29*a* can be formed with a taper 29*b* that expands outwardly toward the detection casing 25.

The rear end of the mounting cavity 29 can be formed with a through-hole 29*c* of a relatively small diameter. The bottom of the pressure-receiving section casing 27*a* can include a bolt hole 29*d* for through which the bolt 26*a* passes.

A plurality of bolt holes 29*e* for receiving the bolts 26*b* can be formed around the mounting cavity 29 in the front surface of the pressure-receiving section casing 27*a*. In the illustrated embodiment, the bolt holes 29*e* are parallel to the mounting cavity 29.

With continued reference to FIG. 5, the bolt holes 29*e* can be in communication with the bolt holes 28*d* of the detection section casing 25. The number of the bolt holes 29*e* equals the number of bolt holes 28*d*.

The mounting cavity 29 can be formed coaxially with the mounting cavity 25*a*. The bolt hole 29*d* and the bolt 26*a* mounted in the bolt hole 29*d* are set perpendicular to the mounting cavity 29 and the mounting cavity 25*a*. The rear surface of the detection section casing 25 and the front surface of the pressure-receiving section casing 27*a* can be set perpendicular to the mounting cavity 29 and the mounting cavity 25*a*.

The steering-force detection section 30*a* can comprise a generally cylindrical guide tube 32 disposed across the rear portion of the mounting cavity 25*a* and the front portion of the mounting cavity 29, a received-pressure detection section 33 mounted in the front portion of the guide tube 32, a pressure-receiving section 34 mounted in the rear portion of the guide tube 32, and a pin 35 interposed between the received-pressure detection section 33 and the pressure-receiving section 34.

Figure 7:
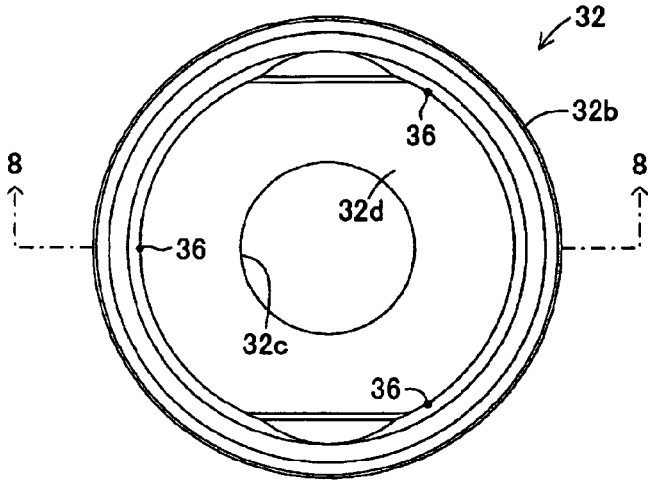
FIG. 7 is a plan view of a guide tube of the steering force detection section unit of FIG. 5.
Figure 8:
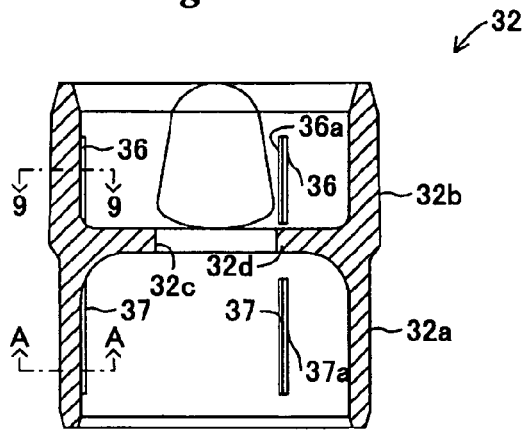
FIG. 8 is a sectional view of the guide tube taken along the line 8-8 of FIG. 7.

As shown in FIGS. 7 and 8, the guide tube 32 can comprise a front housing portion 32*a* having a relatively thin peripheral wall, a rear housing portion 32*b* having a relatively thick peripheral wall, and a partition wall 32*d* formed inside the guide wall 32 between the front housing portion 32*a* and the rear housing portion 32*b*. The front and rear housing portions 32*a*, 32*b* can have generally the same inside diameter as one another.

Figure 9:
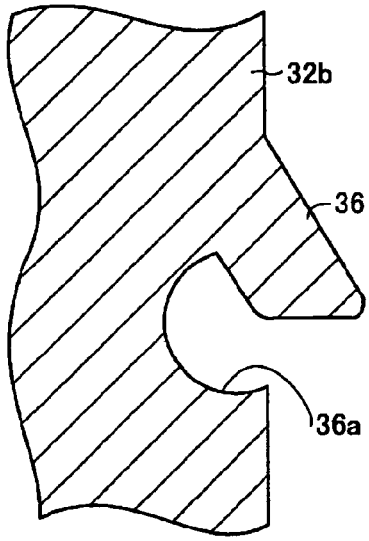
FIG. 9 is a partial sectional view of the guide tube taken along the line 9-9

The partition wall 32*d* can include a hole 32*c* in its center. The inner peripheral surface of the rear housing portion 32*b* can include three ribs 36 extending along its axis at regular intervals (120° in this embodiment) circumferentially. As shown in FIG. 9 each rib 36 can project from the inner peripheral surface of the rear housing portion 32*b* obliquely with respect to the center axis.

With continued reference to FIG. 9, a groove 36*a* having a generally semicircular cross-section can be provided alongside the rib 36. The groove 36*a* can be located at a position where the inner peripheral surface of the rear housing portion 32*b* and an extension of a line connecting the tip of the rib 36 and the center axis of the rear housing portion 32*b* intersect.

With this configuration, when the tip of the rib 36 is pressed toward the inner peripheral surface of the rear housing portion 32*b*, the tip of the rib 36 elastically deforms to retract into the groove 36*a*. Ribs 37 and grooves 37*a*, formed similar to the ribs 36 and the grooves 36*a*, are formed in the inner peripheral surface of the front housing portion 32*a*. The circumferential arrangement of each rib 37 and groove 37*a* is inverted with respect to that of each rib 36 and groove 36*a*. That is, the section taken along the line A-A in FIG. 8 would be the same as FIG. 9.

With reference to FIG. 5, the guide tube 32 can be mounted coaxially with the mounting cavity 29 and the mounting cavity 25*a*, with the front housing portion 32*a* inserted into the connecting opening 28*a* and with the rear housing portion 32*b* inserted into the connecting opening 29*a*.

With continued reference to FIG. 5, the received-pressure detection section 33 can include a rod-like magnetic body 38 disposed in a cylindrical casing 33*a*, and in axial alignment with the casing 33*a*. A bobbin 39*a* around which a coil 39 is wound can be mounted on the outer peripheral surface of the magnetic body 38.

An O-ring 33*b* for sealing between the casing 33*a* and the coil 39 can be mounted between the rear end of the inside surface of the casing 33*a* and the bobbin 39*a*. The received-pressure detection section 33 can be mounted inside the front housing portion 32*a* coaxially with the guide tube 32, so that the rear end of the magnetic body 38 is projected out of the rear end of the casing 33*a* and directed to the hole 32*c* (FIG. 8) of the guide tube 32.

An end of a lead 39*b* can be connected to the coil 39 and can extend into the circuit board housing recess 25*c* to be connected to the electric circuit board 31. The magnetic properties of the magnetic body 38 change depending on the load being added thereto. The coil 39 converts changes in magnetic properties of the magnetic body 38 into changes in electric voltage.

With continued reference to FIG. 5, the pressure-receiving section 34 can comprise a pressure-receiving member 41, a bolt 42 fixed to the pressure-receiving member 42, a ring-shaped plain washer 43, a plurality of spring members 44, and a cylindrical collar 45 including a flange portion 45*a* at its rear end. These components are mounted to a shaft portion 42*a* of the bolt 42.

The spring members 44 can comprise, for example, disc springs. The pressure-receiving member 41 can comprises a large-diameter portion 41*a* on the front side, and a small-diameter portion 41*b* on the rear side. The pressure-receiving member 41 can be disposed in such a manner that its rear end projects from the through hole 29*c* of the pressure-receiving section casing 27*a*. The pressure-receiving member 41 can be mounted so as to be movable forward and rearward inside the pressure-receiving section casing 27*a*.

In the illustrated embodiment, a bearing 46 is mounted on the outer peripheral surface of the large-diameter portion 41*a*, and an O-ring 47 is mounted on the outer peripheral surface of the small-diameter portion 41*b*. The pressure-receiving member 41 is adapted to move smoothly with respect to the pressure-receiving section casing 27*a* in sealed relation with the pressure-receiving section casing 27*a*.

A wave washer 48 can be mounted between the rear end surface of the large-diameter portion 41*a* and the inside wall of the pressure-receiving section casing 27*a*. The shaft portion 42*a* of the bolt 42 is inserted into the plain washer 43 and the disc springs 44, and the collar 45 is inserted between the shaft portion 42*a* and the plain washer 43 and disc springs 44. The bolt 42 in this state is fixed to the large-diameter portion 41*a* of the pressure-receiving member 41.

In one embodiment, the bolt 42 is fastened to the pressure-receiving member 41 so that the disc springs 44 are subjected to a predetermined initial load. With this configuration, the pressure-receiving member 41 preferably does not move, even when a forward force is applied to the rear end of the pressure-receiving member 41, as long as the force does not exceed the initial load. Only when the pressure-receiving member 41 is subjected to a force exceeding the initial load, the disc springs 44 contract and thus the pressure-receiving member 41 moves. As a result, the moving range of the pressure-receiving member 41 can be minimized.

A pin 35 can be mounted between the received-pressure detection section 33 and the pressure-receiving section 34. The pin 35 can comprise a pin body 35*a* and a projection 35*b*. The pin body 35*a* can contact the front surface of the plain washer 43 and can cover a head portion 42*b* of the bolt 42. The projection 35*b* contacts the magnetic body 38 of the received-pressure detection section 33 through the hole 32*c* of the guide tube 32. A gap is provided inside the pin body 35*a* between the rear surface of the pin body 35*a* and the head portion 42*b* of the bolt 42.

When the pressure-receiving member 41 is subjected to a load exceeding the initial load, the disc springs 44 contract, and the pressure-receiving member 41, the bolt 42 and the collar 45 move forward. Movement of the plain washer 43 is restricted by the pin 35, so that the plain washer 43 remains motionless. The pressure-receiving section 34 and the pin 35 are disposed coaxially with the received-pressure detection section 33. Therefore, the load applied to the pressure-receiving member 41 is transmitted to the received-pressure detection section 33 linearly via the disc springs 44, the plain washer 43, and the pin 35.

When the pressure-receiving member 41 is displaced so that its rear surface is flush with the rear surface of the pressure-receiving section casing 27*a*, the pressing piece 22*b* of the pressing member 22 (FIG. 4), which presses against the pressure-receiving member 41, comes in contact with the pressure-receiving section casing 27*a*. Thus, no additional load can be applied to the pressure-receiving member 41, and the pressure-receiving member 41 is unlikely to be damaged.

In the illustrated embodiment, a plate-like sealing material 49 (e.g., a gasket) is provided in the boundary surface between the detection section casing 25 and the pressure-receiving section casings 27*a*, 27*b*. An O-ring 49*a* for sealing can be provided in the taper 29*b*, and is surrounded by the pressure-receiving section casing 27*a* (27*b*), the guide tube 32, and the sealing material 49. A gap between the detection section casing 25 and the pressure-receiving section casing 27*a* or 27*b*, and gaps between other portions are preferably sealed, as for example with a resin material that is filled and set therein.

Figure 10:
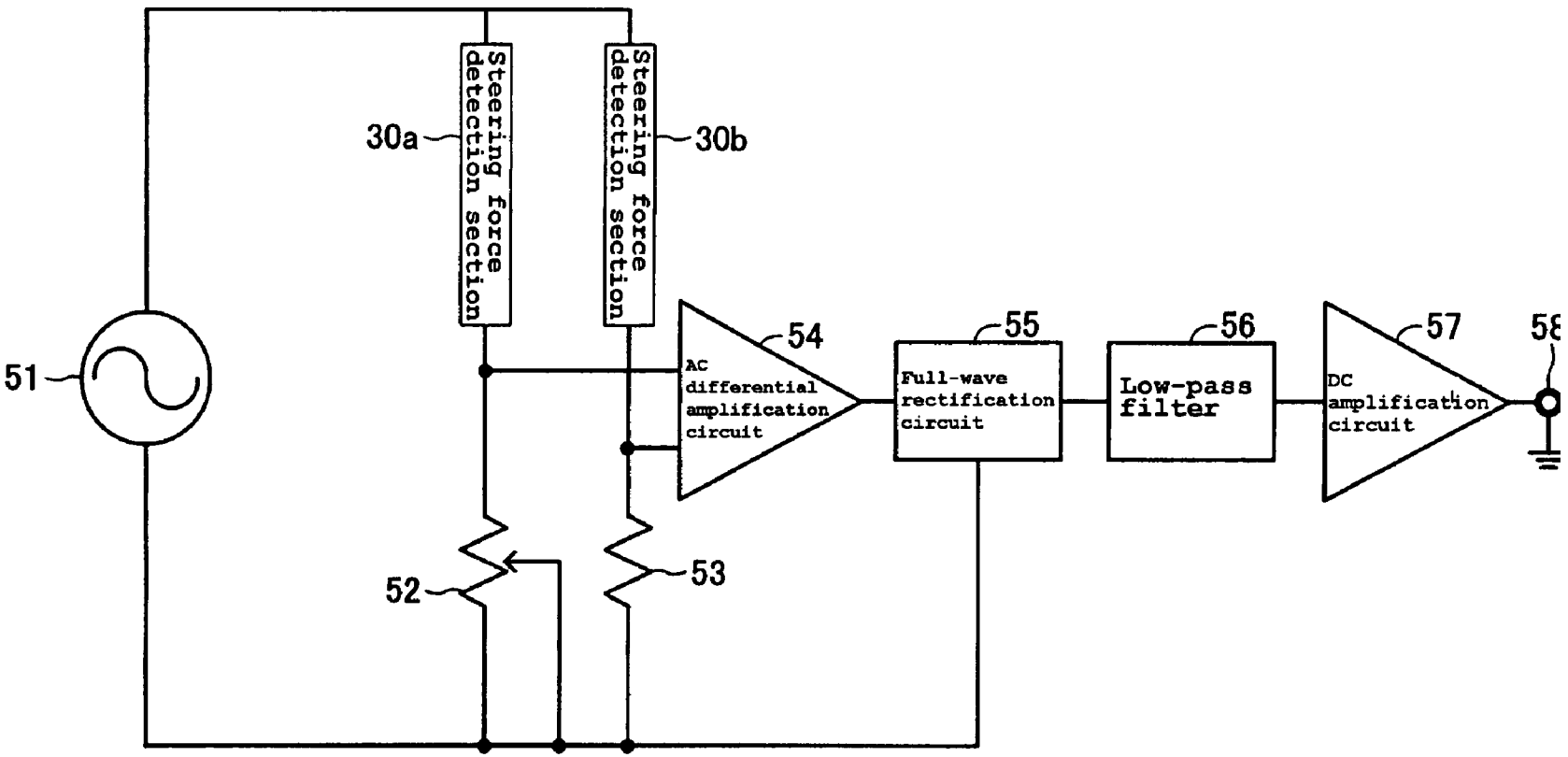
FIG. 10 is a block diagram of a circuit of an electric circuit board of the detection device.

With reference to FIG. 10, the steering-force detection sections 30*a*, 30*b* can be connected to the electric circuit board 31. The electric circuit board 31 can include a circuit, such as an AC oscillating circuit 51.

The AC oscillating circuit 51 can be connected to the respective received-pressure detection sections 33 of the steering-force detection sections 30*a*, 30*b* to apply AC current to the coils 39 (FIG. 5) of the received-pressure detection sections 33. A variable resistor 52 can be connected to the received-pressure detection section 33 of the steering-force detection section 30*a*. Additionally, a bridge fixed resistor 53 can be connected to the received-pressure detection section 33 of the steering-force detection section 30*b*.

The difference in output voltage between the respective received-pressure detection sections 33 of the steering-force detection sections 30*a*, 30*b* is amplified by an AC differential amplification circuit 54, and then rectified by a full-wave rectification circuit 55. Further, low-frequency components can be extracted by a low-pass filter 56, and a terminal 58 outputs a signal voltage amplified by a DC amplification circuit 57. Wire 31*a* (FIG. 5) can connect the terminal 58 to a controller 60 (FIG. 11), and carry the signal voltage according to the load detected by the steering-force detection sections 30*a*, 30*b* from the terminal 58 to the controller 60.

Figure 11:
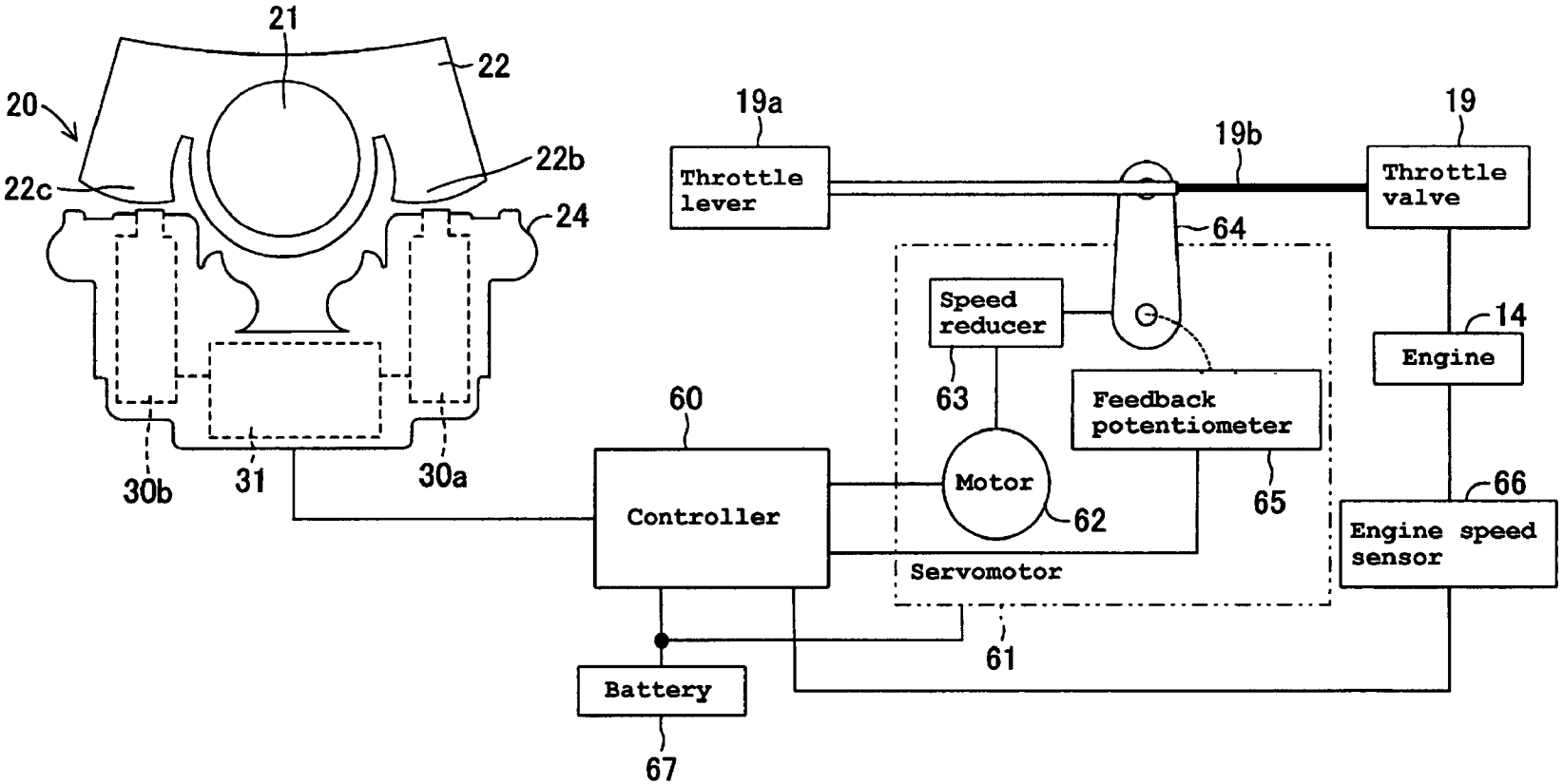
FIG. 11 is a block diagram of the steering force detection device and devices controlled by a controller in communication with the steering force detection device.

With reference to FIG. 11, when the controller 60 receives a signal voltage representing the steering force from the steering-force detection device 20 and the signal voltage is more than a predetermined value, the controller 60 actuates a servomotor 61 so as to change the power output or speed of the engine 14.

The servomotor 61 can be configured to reduce the speed of a motor 62 by means of a speed reducer 63, and transmits to an arm 64 so as to move a throttle wire 19*b* coupling the throttle lever 19*a* and the throttle valve 19. The throttle valve 19 position is thus changed without any operation of the throttle lever 19*a*. In some embodiments, the controller 60 can be configured to cause the servo motor 61 to increase the opening of the throttle valve 19 when the voltage is above a predetermined value.

The arm 64 can include a feedback potentiometer 65 for detecting the swing angle of the arm 64. The controller 60 can be configured to continue to actuate the motor 62 until the swing angle of the arm 64 reaches a target angle, which is set based on the signal voltage from the steering-force detection device 20. The controller 60 can be configured to allow the throttle valve 19 to open to a degree according to the output from the steering-force detection device 20 (steering force applied to the steering handlebars 11 by the operator), to control the output of the engine 14.

With continued reference to FIG. 11, the engine 14 can include an engine speed sensor 66 for detecting the rotational speed of the crankshaft 14*a*. Data signals on the engine speed detected by the engine speed sensor 66 can be transmitted to the controller 60. A battery 67 can be connected to the controller 60 and the servomotor 61, to supply them with power for operation.

To operate the small planing boat A having the above configuration, an operator first turns on a switch (not shown), which can be provided in the vicinity of the steering handlebars 11, to bring the small planing boat A to an operable state. Then, the operator grasps the grip 11*a* of the steering handlebars 11, places his/her fingers on the throttle lever 19*a*, and moves the throttle lever 19*a* toward the grip 11*a*. The throttle wire 19*b* is thus drawn and the throttle valve 19 opens.

As the throttle lever 19*a* is moved closer to the grip 11*a*, the throttle opening increases causing the power output and/or speed of the engine 14 to rise and thus the small planing boat A accelerates. As the throttle lever 19*a* is moved farther away from the grip 11*a*, the throttle opening decreases and the small planing boat A decelerates.

By operating the throttle lever 19*a* for speed adjustment, and rotating the steering handlebars 11, the small planing boat A runs in a direction that varies according to operation of the steering handlebars 11. The push-pull wire 16*a* moves in response to the steering handlebars 11 to swing the steering nozzle 16 for allowing changes in running direction.

When the watercraft operates at low speeds. (e.g., during docking), the throttle lever 19*a* can be positioned so that the engine runs at a relatively low speed. In the illustrated embodiment, the throttle lever 19*a* is moved away from the grip 11*a* for speed reduction. For example, the operator can release the throttle lever 19*a* such that the engine 14 operates at an idle speed. When the engine 14 idles, the engine 14 does not rotate the impeller with sufficient speed to move the watercraft for docking maneuvers, unless the handlebars 11 are rotated to a certain position in which the pressing member 22 contacts the steering force detection device 20.

For example, with the throttle lever 19*a* released, the engine 14 idles (or runs at a relatively low engine speed), the steering handlebars 11 can be rotated until one of the pressing pieces 22*b* and 22*c* engages a corresponding pressure receiving section 34 of the steering force detection system. For example, the handlebars 11 can be rotated clockwise (as viewed from above) to its maximum angle to engage the pressure receiving section 34 of the steering force detection system 30*b*. The handlebars 11 can be rotated counterclockwise to its maximum angle to engage the pressure receiving section of the steering force detection system 30*a*.

When one of the pressing pieces 22*b* and 22*c* engages the steering force detection device 20, the steering force detection device 20 can transmit a signal voltage representing the steering force to the controller 60. The controller 60 can actuate the servomotor 61 based on the signal voltage so that the engine 14 operates at a particular operating condition (e.g., engine speed, engine output, or the like). As such, the propulsion unit 15 provides propulsion when the handlebars 11 are rotated, thus improving the steerability of the watercraft 1 as water is jetted out of the steering nozzle 16.

In some embodiments, when the steering force detection device 20 activates the engine 14, the engine 14 runs at a generally constant speed, even if the steering force is varied. In other embodiments, when the steering force detection device 20 activates the engine 14, the engine 14 runs at a speed related to the steering force measured by the steering force detection device 20. The operator can operate the handlebars 11 to maneuver the watercraft 1 at low speeds as desired.

Advantageously, the operator does not have to operate both the handlebars 11 and the throttle lever 19*a* to effectively steer the watercraft 1. Additionally, the handlebars 11 can be used for relatively fine adjustments to the engine speed. The engine speed can be increased and decreased when the pressure applied by the pressing member 22 is increased and decreases, respectively.

The steering force detection device 20 can therefore improve low-speed steerability by operating the steering handlebars 11. The spring member 44 of the steering force detection device 20 can be preloaded and in a compressed between the pressure receiving member 41 and the plain washer 43. As such, the pressure receiving member 41 is generally not displaced until the steering force of the steering handlebars 11 is applied to the pressure receiving member 41 through the pressing member 22 overcomes the bias of the preloaded spring member 44. When the force applied by the pressing member 22 and overcomes the bias of the spring member 44, the spring member 44 can be further compressed as the pressure receiving member 41 is displaced axially.

In other embodiments, the spring member 44 may not be preloaded. In view of the present disclosure, a skilled artisan can select the type and loading condition of the spring member 44 based on the desired biasing action. The steering force detection device 20 may not affect the engine output by rotating operation of the steering handlebars 11 within maximum steering angles. In other words, normal driving operation is allowed if the steering handlebars 11 are turned within the maximum steering angle, or if the engine speed is above a preset speed.

Since the steering force detection sections 34 are positioned such that the respective pressure receiving directions of the pressure receiving sections 34 are in the same direction, and preferably generally perpendicular to the direction in which the pair of steering force detection sections 34 are spaced. Thus, a casing for housing the paired steering force detection sections can be conveniently manufactured. That is, the machining accuracy of the position and angle of a recess for housing the steering force detection section can be improved which, in turn, can improve the detecting accuracy of the steering force detection section.

The steering force detection device 20 comprises a pair of received pressure detection sections 33 connected to the electric circuit board 31. The integrated received pressure detection sections 33 connected to the electric circuit board 3 can be inserted into the detection section casing 25 through the mounting opening 28 and secured therein, thus facilitating the assembly of the steering force detection device 20. The detection section casing 25 aligns the received pressure detection sections 33. However, the received pressure detection sections 33 can be separately inserted and coupled to the detection section casing 25.

In one method of assembling the steering force detection device 20, the pressure detection sections 33 can be connected to the electric circuit board 31. The received pressure detection sections 33 and the electric circuit board 31 can be mounted together inside the detection section casing 25 by way of the mounting opening 28.

The guide tubes 32 can then be inserted through the connecting openings 28*a* and 28*b*. The guide tubes 32 can be easily advanced over the received pressure detection sections 30. The pins 35 and the pressure receiving sections 34 are then mounted to the guide tubes 32. The pressure receiving section casings 27*a* and 27*b* are then installed to complete the assembly of the steering force detection section unit 24.

In some embodiments, the pair of received pressure detection sections 33 and the electric circuit board 31 can be securely mounted to the detection section casing 25. Preferably the received pressure detection sections 33 and the electric circuit board 31 generally do not move with respect to the pressure receiving direction (e.g., the direction of force applied by the pressing member 22 which correspond to the line of action).

Advantageously, because the received pressure detection section 33 and the pressure receiving section 34 are mounted through the guide tube 32, they can be assembled coaxially with accuracy, even when the detection section casing 25 and the pressure receiving section casings 27*a* and 27*b* are separate members. This provides an advantage in that during assembly line-type manufacturing, the sections 33, 34, can be inserted along the same directions of movement without the need to turn the casing 25, thereby simplifying this portion of the manufacturing process.

The guide tube 32 can also ensure that the pressure receiving section 34 and the received pressure detection section 33 remain aligned during operation. Additionally, the steering force of the steering handlebars 11 can be applied to the pressure receiving section 34 by the pressing member 22. The applied force can be measured and transmitted from the pressure receiving section 34 to the received pressure detection section 33, thus improving the detection accuracy of the steering force.

The ribs 36*a* and 37*a* can limit or prevent some movements (including rattling) of the received pressure detection section 33 and the pressure receiving section 34 within the guide tube 32. As the pressure receiving section 34 and the pressure detection section 33 are mounted into the guide tube 32, the ribs 36, 37 can be displaced into corresponding grooves 36*a*, 37*a* to limit or prevent the removal (e.g., shaving off) of material from the ribs 36, 37.

The pressure receiving section 34 and the pressure detection section 33 can be inserted into the front housing portion 32*a* and the rear housing portion 32*b*, respectively, without forming shavings that can accumulate in the guide tube 32. Thus, detection accuracy of the steering force can be increased due to the reduced amount of shavings or other debris in the guide tube 32. The rib 36 can securely hold the pressure receiving section 34 in the guide tube 37. The rib 37 can securely hold the pressure detection section 33 in the guide tube 32.

The detection section casing 25 and the pressure receiving section casings 27*a*, 27*b* are assembled to house and protect components of the steering force detection device 20. The pressure receiving section casings 27*a*, 27*b* can be toleranced to facilitate the positioning accuracy between the received pressure detection section 33 and the pressure receiving section 34. The illustrated pressure receiving section casings 27*a*, 27*b* align the longitudinal axis of pressure detection section 33 with the axis of the pressure receiving section 34. The illustrated pressure receiving section casings 27*a*, 27*b* align the longitudinal axis of pressure detection section 33 with the axis of the pressure receiving section 34.

The steering force detection device 20 is an exemplary but non-limiting embodiment. In view of the present disclosure, the steering force detection device 20 can be modified based on the application. For example, the width of the connecting openings 28*a*, 28*b* of the corresponding mounting cavities 25*a*, 25*b* may be somewhat smaller on the opening side than on the center side. This configuration permits the received pressure detection sections 33 to be mounted in the guide tubes 32. As such, the received pressure detection sections 33 can be held securely in the mounting cavities 25*a*, 25*b*. The received pressure detection sections 33 can also be easily and accurately positioned relative to the detection section casing 25.

In some embodiments, the ribs and the grooves may be provided in only one of the front housing portion 32*a* and the rear housing portion 32*b*. Additionally, as an alternative to the received pressure detection section 33, a detection device of another type can detect and send a signal indicative of the pressure receiving state of the pressure receiving section 34.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering force detection device for a steering handle of a vehicle, comprising:

a pair of steering force detection sections spaced from each other and near a steering shaft connected to a steering handle of a vehicle, each steering force detection section including a pressure receiving section;

a pressing member being connected to the steering handle or the steering shaft, the pressing member comprising a pair of pressing sections, the pressing member being configured such that one of the pressing sections presses against one of the pressure receiving sections when the steering handle is rotated to a first position, the other pressing section presses against the other pressure receiving section when the steering handle is rotated to a second position;

wherein the steering force detection device being configured to detect a steering force of the steering handle based on a pressure applied by one of the pressing sections to one of the pressure receiving sections, the pair of steering force detection sections being positioned such that the pressure receiving sections are spaced apart by a distance, wherein the pressure receiving sections are actuatable along lines of action that are generally parallel to each other and generally perpendicular to the distance.

2. The steering force detection device of claim 1, wherein the first position and the second position define maximum steering angles of the steering handle.

3. The steering force detection device of claim 1, further comprising a detection section casing and pair of pressure receiving section casings, each of pressure receiving section casings having a pressure receiving section mounting cavity, each pressure receiving section mounting cavity is configured to receive one of the pressure receiving sections, wherein each of the steering force detection sections includes a received pressure detection section configured to detect a pressure applied to one of the pressure receiving sections, each received pressure detection section is housed in a received pressure detection section mounting cavity of the detection section casing, each of the pressure receiving section casings is coupled to the detection section casing.

4. The steering force detection device of claim 3, wherein the pressure receiving section and the received pressure detection section engage each other so as to transmit a pressure applied to the pressure receiving section to the received pressure detection section.

5. The steering force detection device of claim 3, wherein each pressure receiving section comprises a pressure receiving member moveably mounted in one of the pressure receiving section casings, a portion of the pressure receiving member moveable between a first position and a second position, the pressure receiving member protrudes from a surface of the pressure receiving section casing facing the pressing member when the pressure receiving member occupies the first position, the pressure receiving member is retracted in the pressure receiving section casing when the pressure receiving member occupies the second position, the pressure receiving member is movable relative to a washer member, a preloaded spring member is interposed between the pressure receiving member and the washer member, and wherein the pressure receiving member is configured to receive a force applied by the pressing member and is configured to transmit at least a portion of the force to the received pressure detection section through the spring member and the washer member.

6. The steering force detection device of claim 3, wherein an average width of the mounting opening of the received pressure detection section mounting cavity is less than an average width of the received pressure detection section mounting cavity.

7. The steering force detection device of claim 3, further comprising a sealing member positioned between a fitting portion of the detection section casing and the pressure receiving section casing, and a portion of an outer surface of a guide tube engages the fitting portion.

8. The steering force detection device of claim 3, wherein a fitting surface of the detection section casing and a fitting surface of the pressure receiving section casing are generally flat and perpendicular to the line of action of the pressure receiving section.

9. The steering force detection device of claim 3, further comprising a bolt hole extending through at least a portion of the detection section casing and the pressure receiving section casing, the bolt hole having a longitudinal axis that is generally parallel with one of the lines of action of the pressure receiving sections is formed in the detection section casing and the pressure receiving section casing, and a bolt is disposed within the bolt hole coupling the detection section casing and the pressure receiving section casing together.

10. A steering force detection device for a steering handle of a vehicle, comprising:

a pair of steering force detection sections spaced from each other and near a steering shaft connected to a steering handle of a vehicle, each steering force detection section including a pressure receiving section;

a pressing member being connected to the steering handle or the steering shaft, the pressing member comprising a pair of pressing sections, the pressing member being configured such that one of the pressing sections presses against one of the pressure receiving sections when the steering handle is rotated to a first position, the other pressing section presses against the other pressure receiving section when the steering handle is rotated to a second position;

wherein the steering force detection device being configured to detect a steering force of the steering handle based on a pressure applied by one of the pressing sections to one of the pressure receiving sections, the pair of steering force detection sections being positioned such that the pressure receiving sections are spaced apart by a distance, wherein the pressure receiving sections are actuatable along lines of action that are generally parallel to each other and generally perpendicular to the distance; and a detection section casing that comprises two received pressure detection section mounting cavities and a circuit board housing recess, the received pressure detection section mounting cavities are sized and configured to house the received pressure detection sections, the received pressure detection sections are connected to an electric circuit board, the circuit board housing recess is sized and configured to house the electric circuit board, a pair of mounting openings of the two received pressure detection section mounting cavities and the circuit board housing recess are formed on the same side of the detection section casing and are generally perpendicular to the lines of action.

11. A steering force detection device for a steering handle of a vehicle, comprising:

a pair of steering force detection sections spaced from each other and near a steering shaft connected to a steering handle of a vehicle, each steering force detection section including a pressure receiving section;

a pressing member being connected to the steering handle or the steering shaft, the pressing member comprising a pair of pressing sections, the pressing member being configured such that one of the pressing sections presses against one of the pressure receiving sections when the steering handle is rotated to a first position, the other pressing section presses against the other pressure receiving section when the steering handle is rotated to a second position;

wherein the steering force detection device being configured to detect a steering force of the steering handle based on a pressure applied by one of the pressing sections to one of the pressure receiving sections, the pair of steering force detection sections being positioned such that the pressure receiving sections are spaced apart by a distance, wherein the pressure receiving sections are actuatable along lines of action that are generally parallel to each other and generally perpendicular to the distance;

a detection section casing and pair of pressure receiving section casings, each of pressure receiving section casings having a pressure receiving section mounting cavity, each pressure receiving section mounting cavity is configured to receive one of the pressure receiving sections, wherein each of the steering force detection sections includes a received pressure detection section configured to detect a pressure applied to one of the pressure receiving sections, each received pressure detection section is housed in a received pressure detection section mounting cavity of the detection section casing, each of the pressure receiving section casings is coupled to the detection section casing; and a pair of guide tubes, each guide tube being disposed in one of the received pressure detection section mounting cavity of the detection section casings and the pressure receiving section mounting cavity of the pressure receiving section casings, and each of the received pressure detection sections is disposed in a first portion of the guide tube disposed in the detection section casing and the pressure receiving section is disposed in a second portion the guide tube disposed in the pressure receiving section casing.

12. The steering force detection device of claim 11, wherein the guide tubes each have a wall having a inner surface and a rib, the rib extends in the axial direction along the wall, the guide tubes further comprise a first portion configured to receive and house one of the received pressure detection sections and a second portion configured to receive and house one of the pressure receiving sections.

13. The steering force detection device of claim 12, wherein the rib is displaceable towards the inner surface of the guide tube when one of the received pressure detection section and the pressure receiving section is positioned in the guide tube.

14. A steering force detection device for a steering handle of a vehicle, comprising:

a first force sensor and a second force sensor spaced from each other and near a steering shaft connected to a steering handle of a vehicle, the first force sensor and the second for sensor being configured to measure a steering force; and a pressing member being connected to the steering handle or the steering shaft, the pressing member comprising a first pressing section and a second pressing section, the pressing member being configured such that the first pressing section presses against the first force sensor when the steering handle is rotated to a first position, the second pressing section presses against the second force sensor when the steering handle is rotated to a second position;

wherein the first force sensor and the second force sensor are positioned to measure a first force and a second force, respectively, that are generally parallel to each other, and the first force and the second force are offset from each other.

15. The steering force detection device of claim 14, further comprising a first pressure receiving section casing, a second pressure receiving section casing, and a detection section casing, the first pressure receiving section casing and the detection section casing surround and house the first force sensor, and the second pressure receiving section casing and the detection section casing surround and house the second force sensor.

16. The steering force detection device of claim 14, wherein the vehicle is a watercraft having a jet propulsion unit.

17. A steering force detection device for a steering handle of a vehicle, comprising:

a first force sensor and a second force sensor spaced from each other and near a steering shaft connected to a steering handle of a vehicle, the first force sensor and the second for sensor being configured to measure a steering force;

a pressing member being connected to the steering handle or the steering shaft, the pressing member comprising a first pressing section and a second pressing section, the pressing member being configured such that the first pressing section presses against the first force sensor when the steering handle is rotated to a first position, the second pressing section presses against the second force sensor when the steering handle is rotated to a second position;

wherein the first force sensor and the second force sensor are positioned to measure a first force and a second force, respectively, that are generally parallel to each other, and the first force and the second force are offset from each other;

a first pressure receiving section casing, a second pressure receiving section casing, and a detection section casing, the first pressure receiving section casing and the detection section casing surround and house the first force sensor, and the second pressure receiving section casing and the detection section casing surround and house the second force sensor; and a circuit board that is connected to the first force sensor and the second force sensor, the detection section casing has an opening and an interior chamber, the opening is sized such that the circuit board, the first force sensor, and the second force sensor can be passed therethrough and mounted in the interior chamber.

18. The steering force detection device of claim 17, wherein the steering force detection device is generally U-shaped.

19. The steering force detection device of claim 18, wherein the first force sensor and the second force sensor are generally parallel to each other and the circuit board is positioned between the first force sensor and the second force sensor.

20. A steering force detection device for a steering handle of a vehicle, comprising:

a first force sensor and a second force sensor spaced from each other and near a steering shaft connected to a steering handle of a vehicle, the first force sensor and the second for sensor being configured to measure a steering force; and a pressing member being connected to the steering handle or the steering shaft, the pressing member comprising a first pressing section and a second pressing section, the pressing member being configured such that the first pressing section presses against the first force sensor when the steering handle is rotated to a first position, the second pressing section presses against the second force sensor when the steering handle is rotated to a second position;

wherein the first force sensor and the second force sensor are positioned to measure a first force and a second force, respectively, that are generally parallel to each other, and the first force and the second force are offset from each other, wherein the first force sensor and the second force sensor are separated by a distance greater than the diameter of the steering shaft.

* * * * *

UNITED STATES PATENT AND TRADEMARK OFFICE

CERTIFICATE OF CORRECTION

PATENT NO. : 7,430,466 B2
APPLICATION NO. : 11/146728
DATED : September 30, 2008
INVENTOR(S) : Kaneko et al.

It is certified that error appears in the above-identified patent and that said Letters Patent is hereby corrected as shown below:

At column 4, line 22 (Approx.), please delete "9-9" and insert therefore, -- 9-9 of Fig. 8; --.

At column 4, line 24 (Approx.), please delete "detection" and insert therefore, -- steering force detection --.

At column 4, line 34 (Approx.), please delete "Personal" and insert therefore, -- personal --.

At column 4, line 41 (Approx.), please delete "limitation" and insert therefore, -- limitation, --.

At column 5, line 25, please delete "stem" and insert therefore, -- stern --.

At column 7, line 42, please delete "detection casing" and insert therefore, -- detection section casing --.

Signed and Sealed this

Seventh Day of April, 2009

John Doll

JOHN DOLL
*Acting Director of the United States Patent and Trademark Office*